US006110030A

United States Patent [19]

Hashimoto

[11] Patent Number: 6,110,030

[45] Date of Patent: Aug. 29, 2000

[54] ULTRA FINE GROOVE CHIP AND ULTRA FINE GROOVE TOOL

[76] Inventor: Hiroshi Hashimoto, 1117-12 Hinata, Isehara-shi, Kanagawa-ken, Japan, 243-0203

[21] Appl. No.: 09/271,623

[22] Filed: Mar. 17, 1999

[30] Foreign Application Priority Data

Mar. 23, 1998 [JP] Japan ..... 10-074485

[51] Int. Cl.[7] ..... B23F 21/03; B24B 1/00

[52] U.S. Cl. ..... 451/540; 451/41

[58] Field of Search ..... 451/41, 450, 540, 451/548, 552, 554; 407/115, 114; 125/30.01, 39

[56] References Cited

U.S. PATENT DOCUMENTS 5,054,246 10/1991 Phaal et al. ..... 125/39
5,454,752 10/1995 Sexton et al. ..... 451/548
5,782,682 7/1998 Han et al. ..... 451/548

FOREIGN PATENT DOCUMENTS 3-117566 of 1991 Japan .
3-131477 of 1991 Japan .
3-196976 of 1991 Japan .

*Primary Examiner*—Rodney A. Butler
*Attorney, Agent, or Firm*—Ladas & Parry

[57] ABSTRACT

The present invention relates to an ultra fine groove chip (or tip) and an ultra fine groove tool, wherein thermal damage is reduced as coolant retained in grooves stops heat generation when working in shear (ductile) mode and whereby good quality of worked surface is obtained. The present invention comprises an ultra fine groove chip, wherein a chip made of hard material selected from the group consisting of diamond, cubic boron nitride, tungsten carbide, cemented carbide, high-speed steel, ceramics and others has its face engraved with a number of fine grooves to form working surfaces, and whereby each working surface sectioned by grooves constitutes an ultra fine edge. The invention also comprises an ultra fine groove tool which is provided with a rotatable base board and at least one ultra fine groove chip, wherein the board constituting a holder is holding the ultra fine groove chip.

13 Claims, 8 Drawing Sheets

FIG. 6A
FIG. 6B
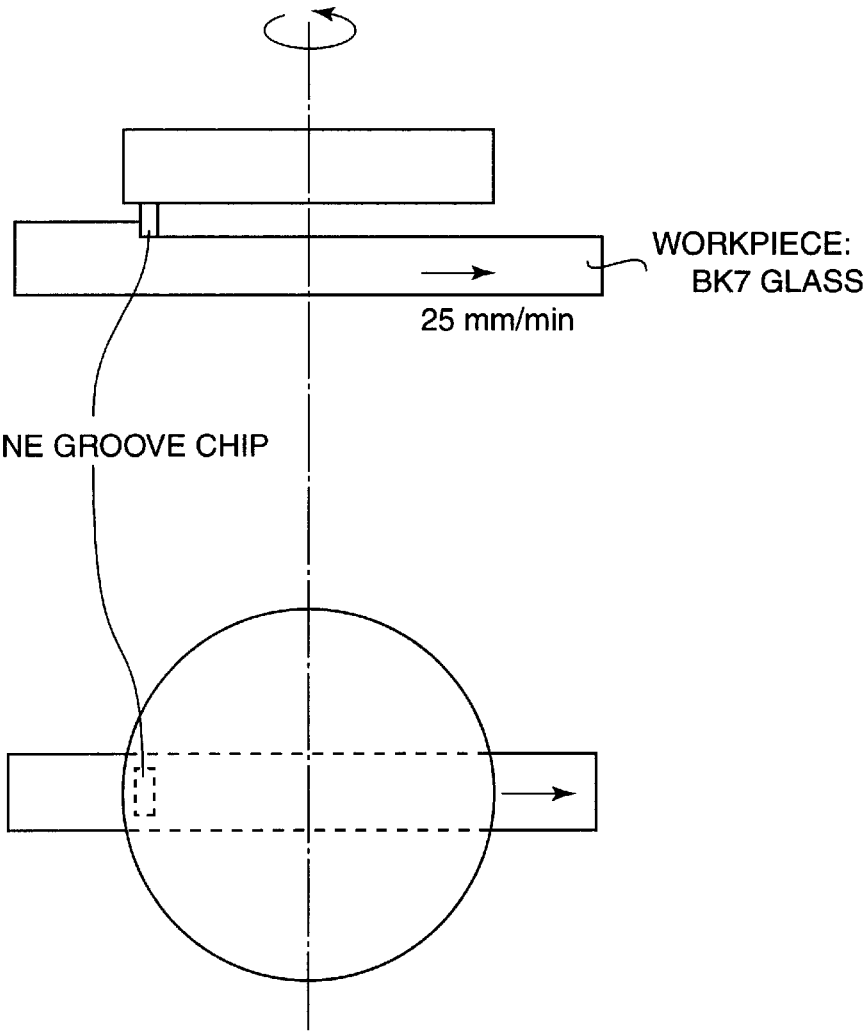
FIG. 7A
FIG. 7B
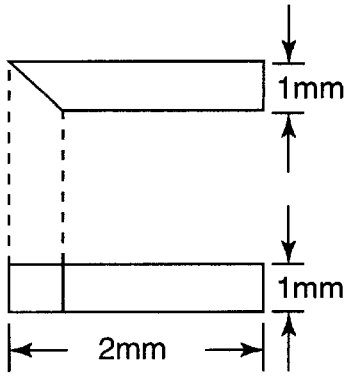

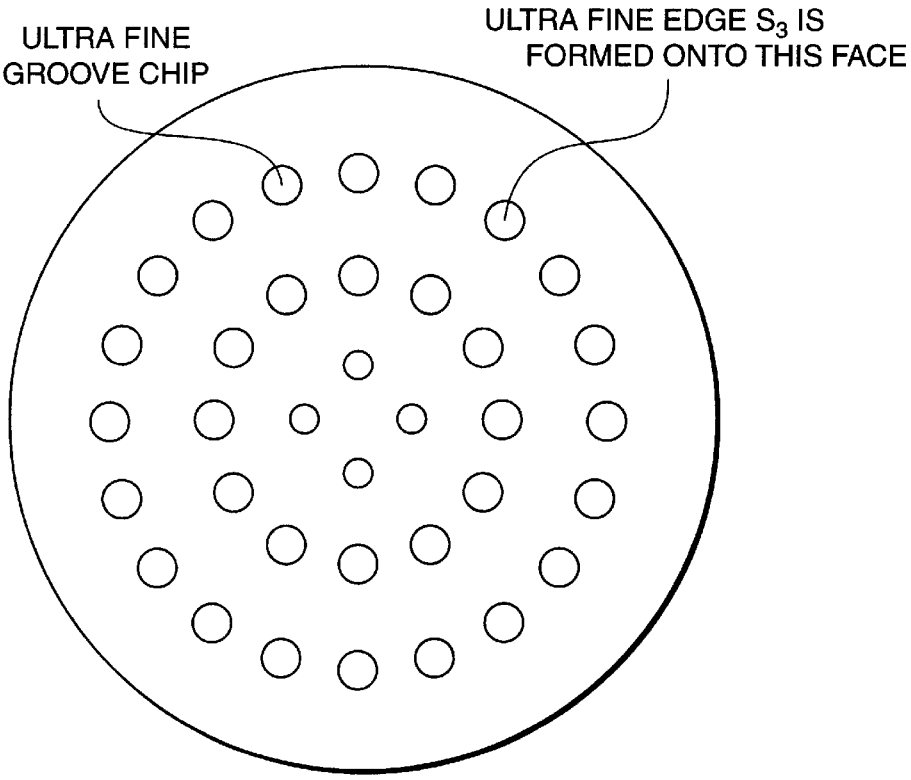
FIG. 8A
FIG. 8B
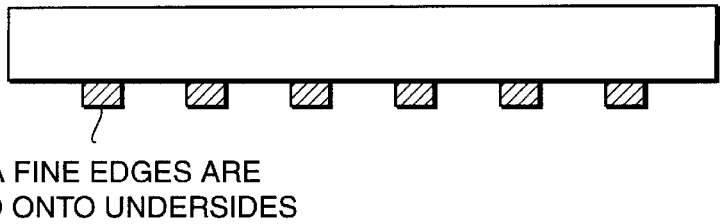

ULTRA FINE GROOVE CHIP AND ULTRA FINE GROOVE TOOL

BACKGROUND OF THE INVENTION

1. Field of the Invention

The present invention relates to an ultra fine groove chip (or tip) having less susceptibility of the working surface to thermal damage during the working in shear (ductile) mode and having high efficiency in disposing of swarf, and to an ultra fine groove tool provided with the ultra fine groove chips.

2. Description of the Related Art

With such difficult-to-cut brittle hard materials such as metal, crystals, glass or the like, it is vitally important to maintain the sharpness of tips by maintaining working resistance at a low level and by controlling heat, thereby maintaining the quality of work surface constant.

Brittle hard materials are particularly susceptible to surface cracking during working, which often is a cause of brittle fracture. The susceptibility to cracking of the brittle hard material is more pronounced when a larger-edged tool is used in any grinding, cutting or lapping process. Further, the fracture of a material occurs more often in a "brittle mode", which shall be considered to mean, throughout this specification, a state, wherein the surface of the brittle hard material is covered with cracks, as is often seen in a case when glass is rubbed with rough sandpaper, white powder is generated, and the glass turns opaque due to cracks produced on its surface.

Generally, when grinding a brittle hard material, swarf generated by brittle-mode grinding tends to be rough, and those by shear-mode tend to be fine and uniformly shaped. Here, the "shear mode" (or ductile mode) shall be understood to mean, throughout this specification, the following state. For example, the glass, as described above, if rubbed with a rough sandpaper, generates white powder and turns opaque due to cracks on its surface. On the other hand, if rubbed with a fine sandpaper under a very slight pressure, no white powder is generated and no cracking is caused. Such a crack-free state of the glass surface is called the shear mode where the initial transparency of the glass is mostly maintained after the glass is ground with very fine sandpaper under very slight pressure.

As an example of a tool employed for such working processes for workpieces as grinding, lapping, polishing or cutting, diamond grinding wheels are known for their excellent characteristics in performance, durability, precise finishing and so on.

1) Grinding

The following types (1)–(3) of the diamond grinding wheels are known:

(1) An electroplated grinding wheel, wherein diamond abrasives are affixed by nickel-plating (type-1 diamond grinding wheel);

(2) A grinding wheel, wherein diamond abrasives initially bonded onto a base surface by nickel-plating are subsequently reversed to obtain evenly leveled abrasive tops (type-2 diamond grinding wheel); and (3) A grinding wheel formed by sintering a mixture of fine diamond abrasives and a bonding material made of elastic resinoid or metal, which is particularly suitable for grinding brittle hard materials in the shear mode (type-3 diamond grinding wheel).

The above diamond grinding wheels of the related arts, however, have the following problems, respectively.

That is, the type-1 diamond grinding wheel has problems such as: (1) it has a limit in reducing surface roughness since sizes of diamond abrasives are irregular, and (2) it has a limit in reducing surface roughness since amount of abrasion and crushing state among the diamond abrasives are different each other due to irregularity of crystal orientations of the respective abrasive.

The type-2 diamond grinding wheel has problems such as: (1) a manufacturing process to evenly put the diamond abrasive tops in order by reversing is complicated, (2) amount of abrasion and crushing state among the diamond abrasives are different each other since crystal orientations of the respective abrasive are irregular, and (3) it is difficult to control the density of the diamond abrasive.

Lastly, the type-3 diamond grinding wheel has the following problems: (1) the volume of material removed per unit time is small and grinding efficiency is low because the diamond abrasives are very fine, (2) scratch is created on the workpiece surface due to loose abrasives, (3) the grinding force is reduced by loading and glazing of the grinding wheel during the grinding process, and the grinding burn occurs on the workpiece surface due to the grinding heat which is generated during the grinding process, and (4) it is liable to variations in grinding performance, trueing and finishing efficiency due to a sintered product.

2) Cutting

Conventionally, a wide variety of materials and shapes have been adopted for cutting tools, and this is evident from manufacturing history. However, the necessity of using large-sized tips in cutting a hard-cutting material, whether it is metal or brittle hard material, is accompanied by heat generation. As a result, deterioration in shape precision caused by unavoidable wear has not been preventable.

3) Lapping

Lapping differs from the grinding in that it is a constant-pressure processing, whereas the latter is a constant-feed processing. The manufacturing method of a lapping tool, therefore, has conventionally been identical with that for the grinding.

SUMMARY OF THE INVENTION

An object of the present invention, therefore, is to provide an ultra fine groove chip (or tip), wherein the coolant (or working fluid) retained in grooves serves to reduce thermal damage by stopping heat generation during the working. The advantage is particularly remarkable in a shear mode (or ductile mode) working of brittle hard materials.

Another object of the present invention is to provide an ultra fine groove chip, wherein swarf removed from the workpiece is confined within grooves on the surface and are kept from interfering with the workpiece, thus realizing high working efficiency.

Still another object of the present invention is to provide an ultra fine groove chip, wherein the working resistance is small and constant, thus realizing high efficiency and high working precision.

The inventor has found that a tip made of hard material can serve this purpose, wherein the hard material may be selected from the group consisting of diamond, cubic boron nitride, tungsten carbide, cemented carbide, high-speed steel, ceramics and others, and the tip has its face engraved with a number of fine grooves to form working surfaces, and whereby each working surface separated by grooves constitute an ultra fine edge. The present invention is based on the above finding. Further, the tool according to the present invention does not need the load to the workpiece for the grinding. Although the conventional grinding method is operated as the load-constrained grinding, the method according to the present invention is operated as the depth of cut-constrained grinding.

According to one aspect of the present invention, there is provided an ultra fine groove chip (or tip), wherein a chip made of hard material selected from the group consisting of diamond, cubic boron nitride, tungsten carbide, cemented carbide, high-speed steel, ceramics, and others has its face engraved with a number of fine grooves to form working surfaces, and whereby each working surface separated by said grooves constitute an ultra fine edge.

According to another aspect of the present invention, there is provided an ultra fine groove tool which is provided with a rotatable base board and at least one ultra fine groove chip, wherein said board holds as a holder the ultra fine groove chip and a chip made of hard material selected from the group consisting of diamond, cubic boron nitride, tungsten carbide, cemented carbide, high-speed steel, ceramics, and others, has its face engraved with a plurality of fine grooves to form working surfaces, and whereby a working surface thus separated by grooves constitutes an ultra fine edge.

The nature, principle and utility of the invention will become more apparent from the following detailed description when read in conjunction with accompanying drawings.

BRIEF DESCRIPTION OF THE DRAWINGS

In the accompanying drawings:

FIGS. 6A and 6B illustrate a comparative test using two mono-crystal diamond tips of exactly the same shape, but one having ultra fine groove chips and the other without them, wherein FIG. 6A is a side view and FIG. 6B is a plane view;

FIGS. 7A and 7B illustrate a shape of the ultra fine groove chip, wherein FIG. 7A is a side view and FIG. 7B is a plan view;

FIGS. 8A and 8B illustrate an ultra fine groove lapping tool, wherein FIG. 8A is a rear plan view and FIG. 8B is a front view;

DESCRIPTION OF THE PREFERRED EMBODIMENTS

Figure 1:
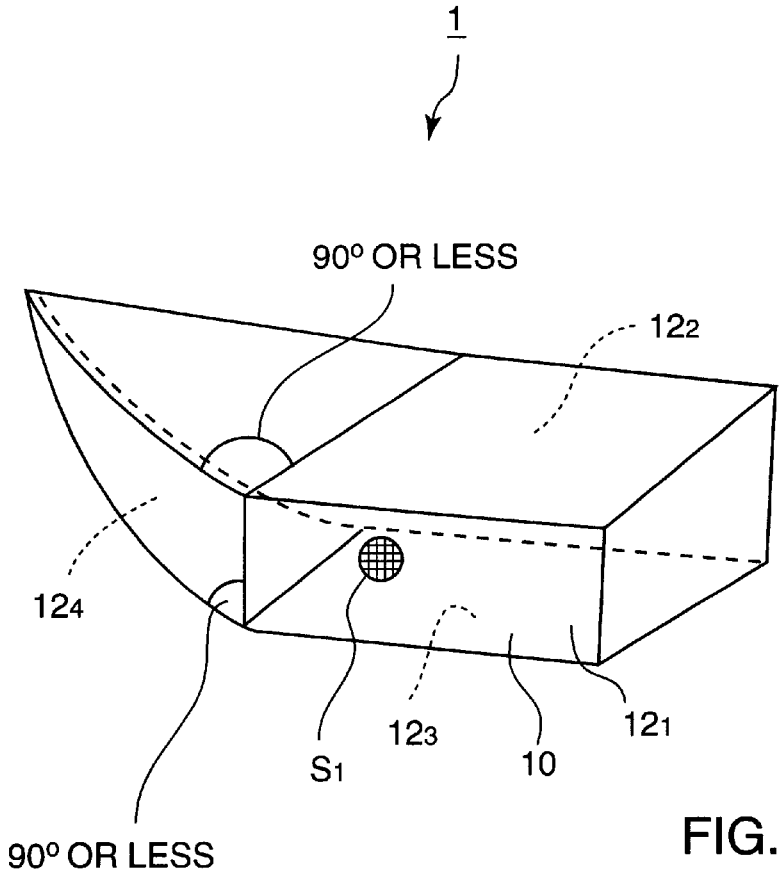
FIG. 1 is a schematic perspective view of a boat-shaped ultra fine groove chip (or tip)

An ultra fine groove chip (or tip) according to the present invention has its working surface grooved, thereby an edge of the groove constituting a negative cutting edge. The grooves on the working surface form a plurality of cutting edges, thus increasing the number of edges per surface area and decreasing the work load of each edge.

Thermal damage during the working is minimized, as the working fluid guided by and retained in the grooves stops heat generation. Interference of swarf with the workpiece is minimized, as removed swarf is confined within grooves of the working surface.

A small and constant working resistance makes a shear mode process possible, thus realizing high precision of the worked surface. Preferably the groove on the working surface shall have a depth of 0.001 $\mu$m or more so as the working force of an ultra fine edge can be maintained at the same level, irrespective of the resistance (grinding resistance, cutting resistance, lapping resistance). Also, it is important that the depth shall be at least 0.01 $\mu$m so as to permit smooth flow of the coolant (grinding fluid, cutting fluid, polishing fluid) and smooth disposal of swarf.

The ultra fine area of each edge constituted on the working surface enables production of swarf small enough to satisfy conditions for obtaining a shear mode surface. Further, the size of the area accounts for the sustainability of a constant working force and the over-heating by friction with the workpiece. If the area of an edge is 0.000001 $\mu m^2$ or less, the working force of the ultra fine edge drops sharply and proper working force is no longer sustainable. On the other hand, if the area is 100,000 $\mu m^2$ or more, a degradation of the ultra fine edge is induced in a short time and an over-working on the work surface (work layer) occurs, thus resulting in insufficient surface precision. The proper area of each edge, therefore, is in a range from 0.000001 to 100,000 $\mu m^2$.

Referring now to the drawings, the ultra fine groove chip according to the present invention and embodiments thereof will be described.

Embodiment 1

First, description will be made of the first embodiment illustrated in FIGS. 1–3.

Figure 2:
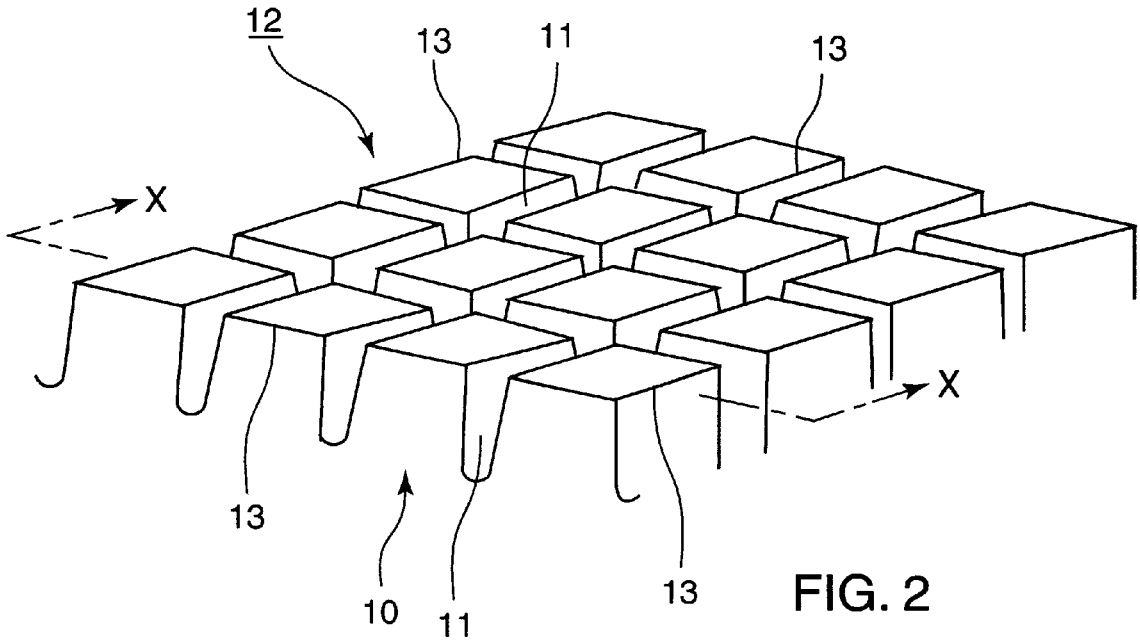
FIG. 2 is an enlarged schematic view of $S_1$ part on a facade of ultra fine edges shown in FIG. 1.
Figure 3:
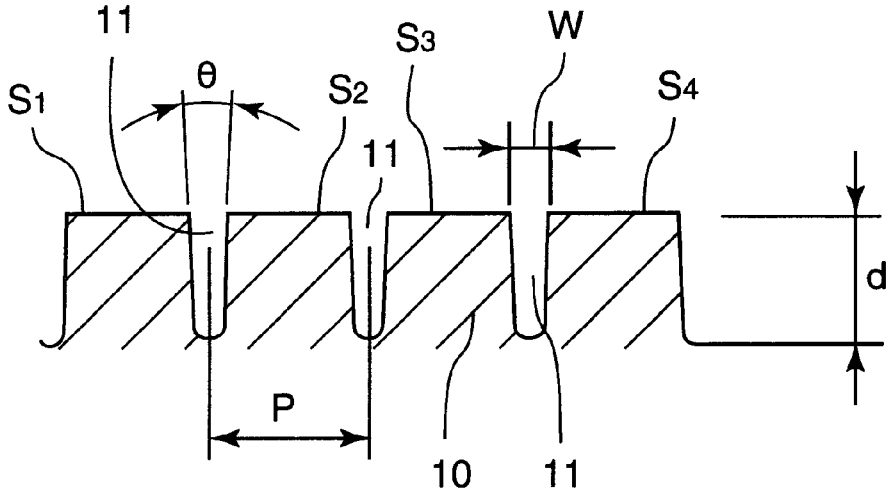
FIG. 3 is a sectional view taken along the line X—X of FIG. 2.

FIG. 1 is a schematic perspective view of a boat-shaped ultra fine groove chip according to the present invention, FIG. 2 is an enlarged schematic view of an $S_1$ part on a facade of the ultra fine groove chip shown in FIG. 1, and FIG. 3 is a sectional view taken along a line X—X of FIG. 1.

In these drawings, an ultra fine groove chip 1 comprises a tip 10, wherein its face has a plurality of fine grooves 11 regularly engraved by applying a laser or electric energy or by a method of chemical vapor deposition or machining to form working surfaces 12, and whereby each working surface separated by grooves constitutes an ultra fine edge 13. By using the ultra fine edge 13, materials can be worked under a small resistance, and this small and constant resistance as well as the guaranteed shear mode working results in an excellent precision of the worked surface.

Thermal damage during the working is minimized, as the working fluid guided by and retained in the fine grooves 11 stops heat generation. Interference of swarf with the workpiece is maximally avoided, as removed swarf is confined within the fine grooves 11 of the working surfaces 12. Preferably, the fine grooves 11 on the working surface 12 shall have depth of 0.001 $\mu$m or more so that the working force of the ultra fine edge 13 can be kept at the same level irrespective of the resistance (grinding resistance, cutting resistance, lapping resistance). It is also important that the depth "d" of the groove 11 be at least 0.01 $\mu$m in order to secure smooth flows of the coolant (grinding fluid, cutting fluid, polishing fluid) and smooth disposals of swarf.

Areas $S_1$, $S_2$, $S_3$, $S_4$, . . . of each ultra fine edge 13 constituted on the working surface 12 accounts for the sustainability of a constant working force and the overheating generated by the friction with the workpiece. If the area of an ultra fine edge 13 is 0.000001 $\mu m^2$ or less, its working force drops sharply and the proper level is no longer sustainable. On the other hand, if the area of the ultra fine edge 13 is 100,000 $\mu m^2$ or more, a degradation of the ultra fine edge 13 is induced in a short time, resulting in insufficient working precision. The proper area of each edge, therefore, is in the range from 0.000001 to 100,000 $\mu m^2$.

The ultra fine groove chip 1 illustrated in FIG. 1 has the working surfaces 12 consisting of side faces $\mathbf{12}_1$ and $\mathbf{12}_2$, bottom face $\mathbf{12}_3$, and bow bottom face $\mathbf{12}_4$, each being shaped in flat or curved planes. The working surfaces 12 may also consist of curved planes only.

In FIG. 3, the fine grooves 11 are formed to have a pitch "p" in the range of from 0.001 $\mu$m to 1 mm and a width "w" of 0.01 $\mu$m or more.

As mentioned above, although a wide variety of materials and shapes have been adopted for cutting tools, the necessity of using large-sized tips in cutting a hard-cutting material, whether it is metal or brittle hard material, is accompanied by heat generation. As a result, deterioration in shape precision caused by unavoidable wear has not been preventable. For solving the above problems, the ultra fine groove chip according to the present invention is extremely effective.

Embodiment 2

Figure 4:
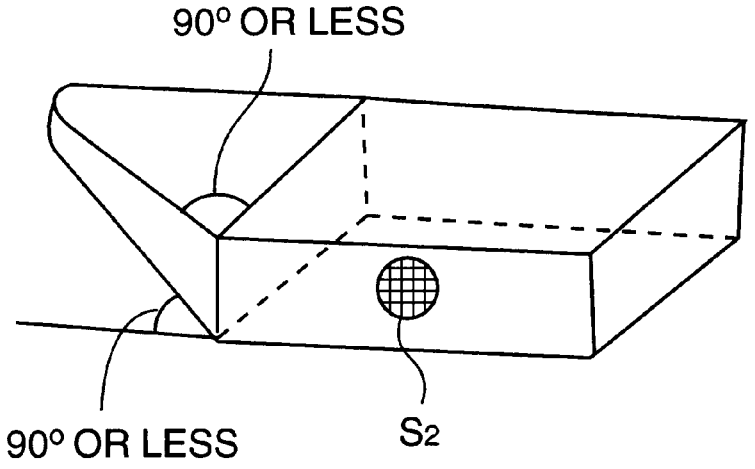
FIG. 4 is a schematic perspective view of an ultra fine groove chip as illustrated in FIG. 1, wherein the bow bottom face has a flat plane with an edge line thereof being straight.

A second embodiment is described with reference to FIG. 4, FIG. 5, FIGS. 6(A)and 6(B), FIGS. 7(A) and 7(B). FIG. 4 is a schematic perspective view of an ultra fine groove chip as illustrated in FIG. 1, wherein a bow bottom face $\mathbf{12}_4$ has a flat plane with an edge line thereof being straight. The ultra fine groove chip as illustrated in FIG. 1 and FIG. 4 may be used as an edge for face cutting, cylindrical cutting, and planing on a fly cutter, a turning machine and so on. The ultra fine groove chip may also be used as a grinding edge not only for cup wheels as illustrated in FIGS. 10, 11, 14 and 15 (which shall be referred to later) but also for other wheels such as plane cup wheels.

Figure 5:
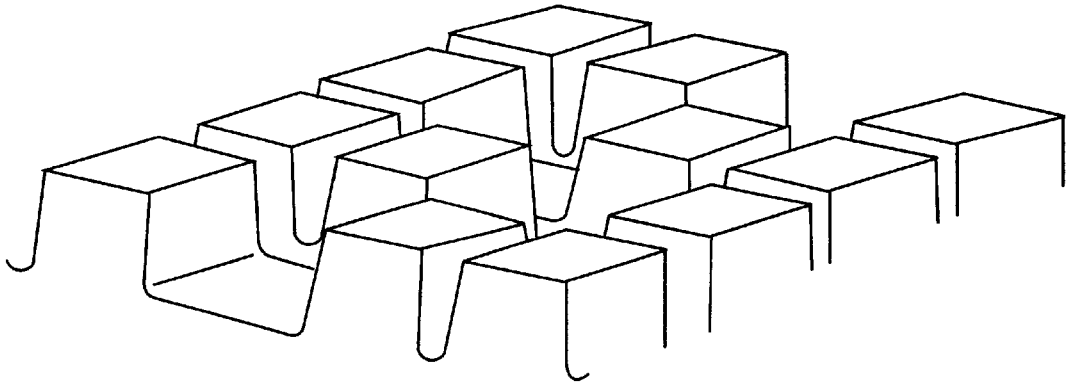
FIG. 5 is an enlarged schematic view of $S_2$ part on a facade of ultra fine edges of the ultra fine groove chip illustrated in FIG. 4.

FIG. 5 is an enlarged schematic view of an $S_2$ part on a facade of an ultra fine edge of the ultra fine groove chip illustrated in FIG. 4. Whereas the arrangement of the ultra fine groove chips illustrated in FIG. 2 is regular, that of FIG. 5 is irregular. Depending on materials and working conditions, the irregular arrangements sometimes bring about excellent effects in cooling and disposal of swarf.

Turning now to a comparative test (with reference to FIGS. 6(A) and 6(B)) using two mono-crystal diamond tips of exactly the same shape, but one having ultra fine groove chips and the other without these, results of the test are presented below. The workpiece is BK7 glass and the feed speed is set at 25 mm/min.

Beginning with the one with ultra fine groove chips, the workpiece surface is in full brittle mode at a working speed of 1500 rpm. At 3000 rpm, the shear mode is somewhat notable.

As the revolution speed gradually increased from 4500 rpm through 6000 rpm, the shear mode area also increased to reach maximum at 7500 rpm. This is results in the amount of material removed per the ultra fine edge becoming minimized. The cooling effect secured by coolant being fed within grooves also contributes to sustained normal working conditions even at higher revolution speeds.

In the other test, under the same working conditions, using the same shaped tips but without ultra fine groove chips, the entire surface of the same material continued to show the brittle mode despite increases in revolution speed. The result of the above test also demonstrates the remarkable advantages of the ultra fine groove chip.

As stated above, the manufacturing method of a lapping tool is identical with that for grinding and therefore drawbacks and problems to be solved are also the same. Accordingly, by using an ultra fine groove tool provided with ultra fine groove chips, the following advantages are achieved: (1) an improved distribution of abrasive density or an equivalent thereof is effectively obtained, (2) it is possible to uniformly put the crystal orientation of the ultra fine groove cutting chip in order to a friction-optimized direction, and (3) it is possible to uniformly put size and height of the ultra fine groove chips in order and this is equal to the uniformity of the size and protrusion of abrasives.

In accordance with the design as described above, a lapping tool can be manufactured by such methods as laser, electric energy, chemical vapor deposition and machining or the like. The tool brings about such advantages as an improved lapping efficiency, an improved surface roughness, and a reduction of work affected layer.

Embodiment 3

FIG. 8(A) is a rear plan view of an ultra fine groove lapping tool and FIG. 8(B) is an elevational view of an ultra fine groove lapping tool. The ultra fine groove chips are arranged on a disk with ultra fine edges $S_3$ formed onto undersides of the pellets. An enlarged view of the ultra fine edges $S_3$ is the same as those illustrated in FIGS. 2 and 5. While the shape of pellets illustrated in FIGS. 8(A) and 8(B) are cylindrical, other columnar shapes such as quadrilaterals, ellipses and polygons may be employed with ultra fine edges formed onto the undersides thereof. The pellets may also be arranged to have bows of boat-shaped ultra fine groove chips as illustrated in FIGS. 1 and 4 traveling in the direction of rotation.

Figure 9:
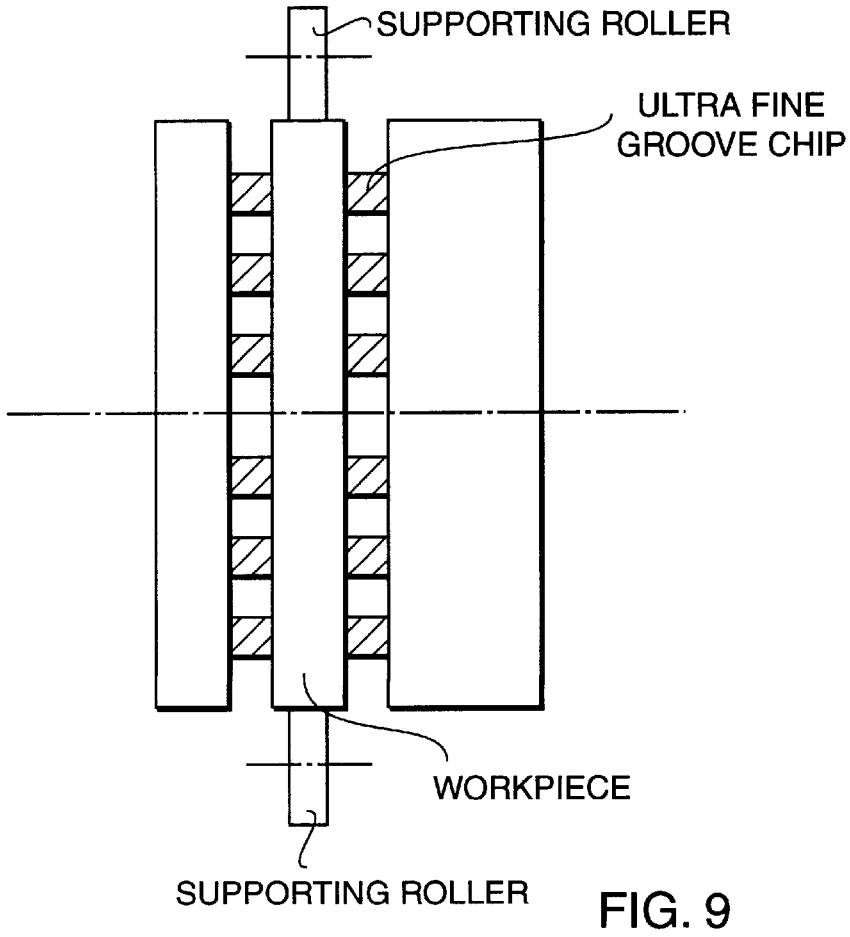
FIG. 9 is a schematic view illustrating a configuration of another ultra fine groove lapping tool.

FIG. 9 is a schematic view illustrating the configuration of another ultra fine groove lapping tool. This embodiment shows an application wherein a couple of ultra fine groove lapping tools are simultaneously processing each surface of a workpiece. Specifications of the ultra fine edges and the ultra fine groove chips as described in grinding.

Embodiment 4

Figure 10:
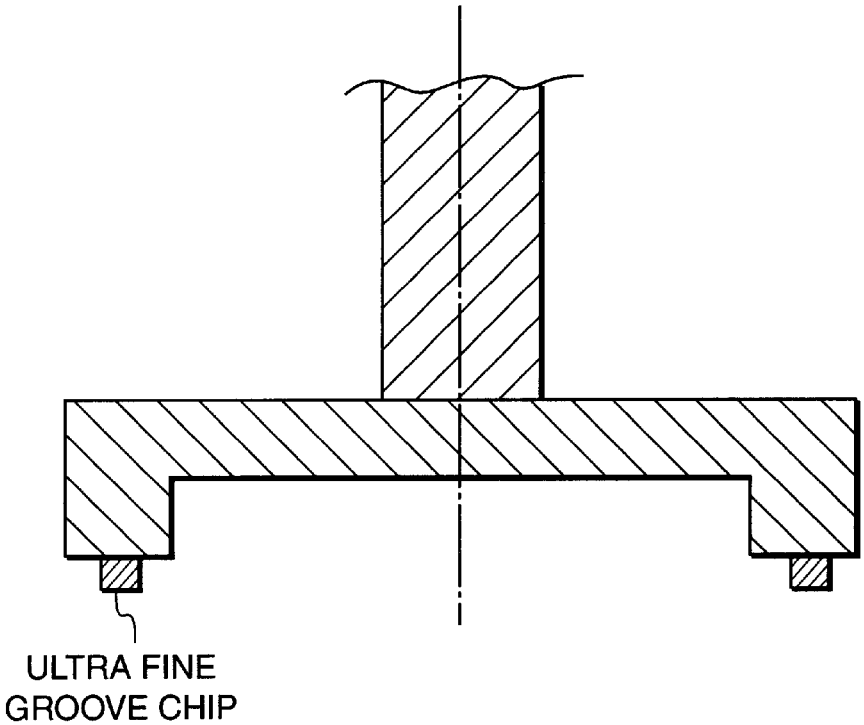
FIG. 10 is a sectional view illustrating still another ultra fine groove tool.
Figure 11:
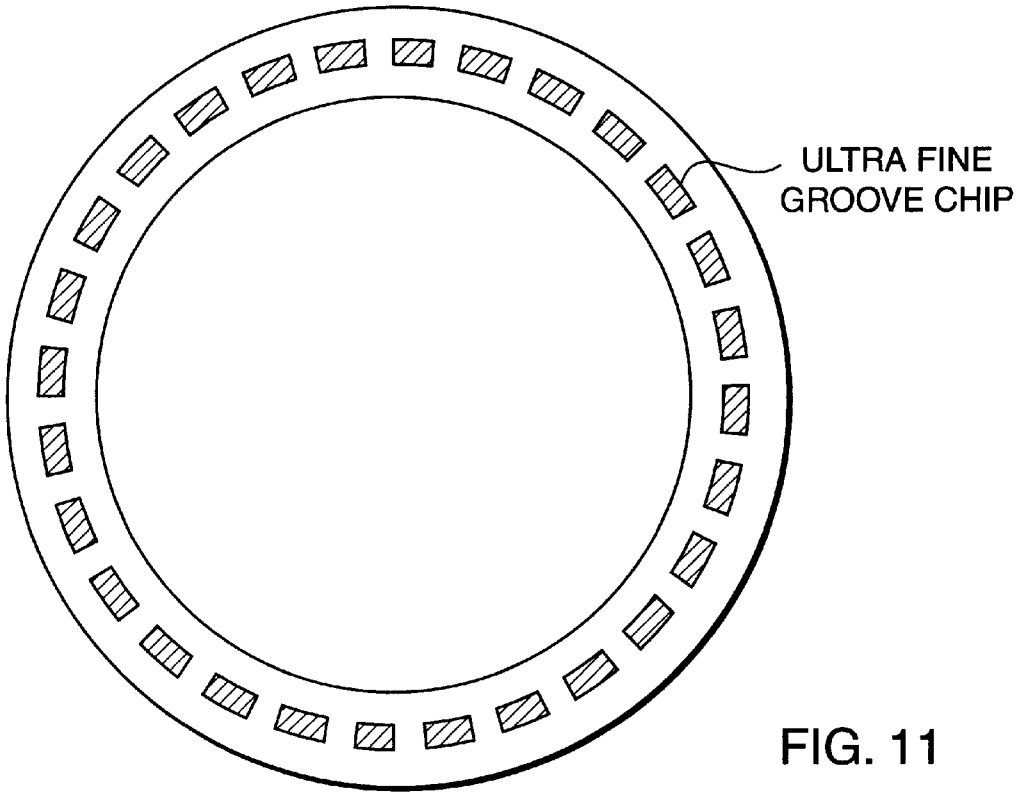
FIG. 11 is a rear plan view of the ultra fine groove tool of FIG. 10.

FIG. 10 is a sectional view illustrating yet another ultra fine groove tool, and FIG. 11 is a rear plan view of the ultra fine groove tool of FIG. 10. This embodiment shows an application of the ultra fine groove tool, wherein the ultra fine groove chips made of diamond are arranged along concentric circles. A result of a comparison test with a conventional diamond tool revealed differences between the two as presented below.

The test was made on a mono-crystal silicon wafer as the test-piece by the same method as described in FIGS. 6(A) and 6(B). However, the feed speed was set at 100 mm per minute. The tool was rotated at 2000 rpm and the cutting depth was set at 2 $\mu$m.

Figure 12:
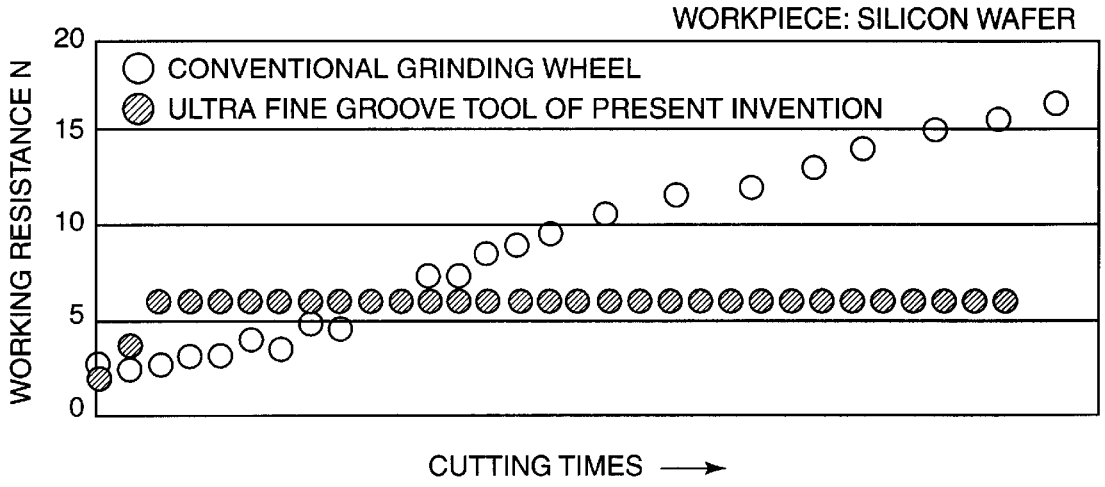
FIG. 12 is a graph showing the change in working resistance of a silicon wafer over accumulated cutting times.
Figure 13:
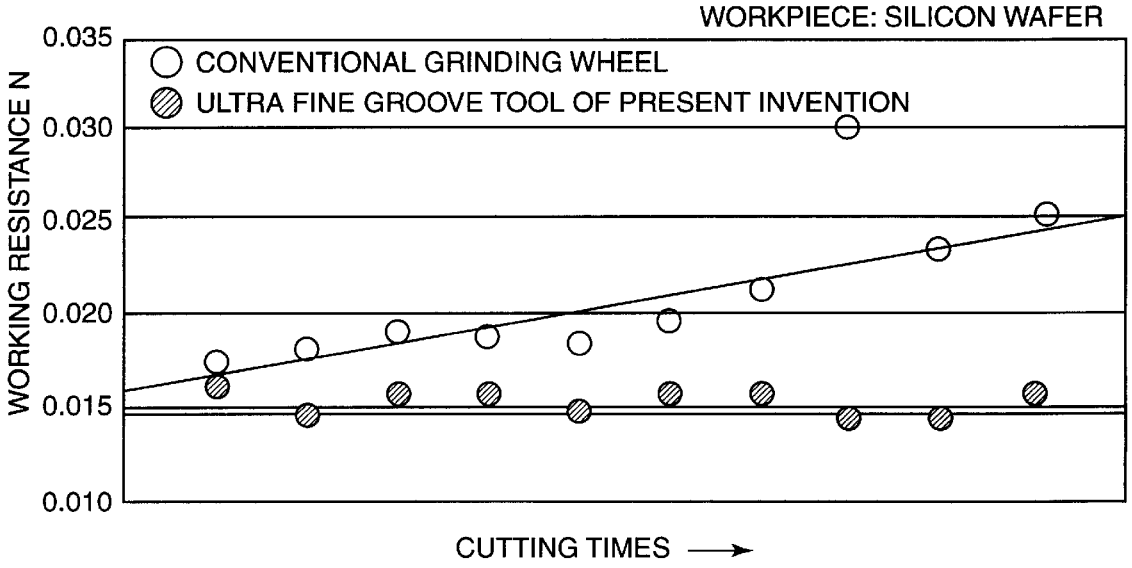
FIG. 13 is a graph showing the change in surface roughness of a silicon wafer over accumulated cutting times.

FIG. 12 is a graph showing the change in working resistance of a silicon wafer over accumulated cutting times. Namely, the graph shows the change of working resistance during the processing. The conventional tool showed a gradual increase in working resistance caused by the degradation of diamond abrasives due to heat generation and by loading of swarf. The ultra fine groove tool, however, showed a constant working resistance without any such problems.

FIG. 12 is a graph showing the change in surface roughness of a silicon wafer over accumulated cutting times. Namely, the graph shows the roughness corresponding to the accumulated volume of materials removed. In the case of a conventional tool, non-uniform orientations of diamond abrasives caused the uneven abrasion, which further caused the non-level protrusion of abrasives. Accordingly, the roughness increased as the accumulated volume of materials removed increased. In the ultra fine groove tool, all the ultra fine edges have the same orientation and the same initial protrusion. Therefore, no change in roughness occurs. As such, the difference between the two is clear.

Embodiment 5

Figure 14:
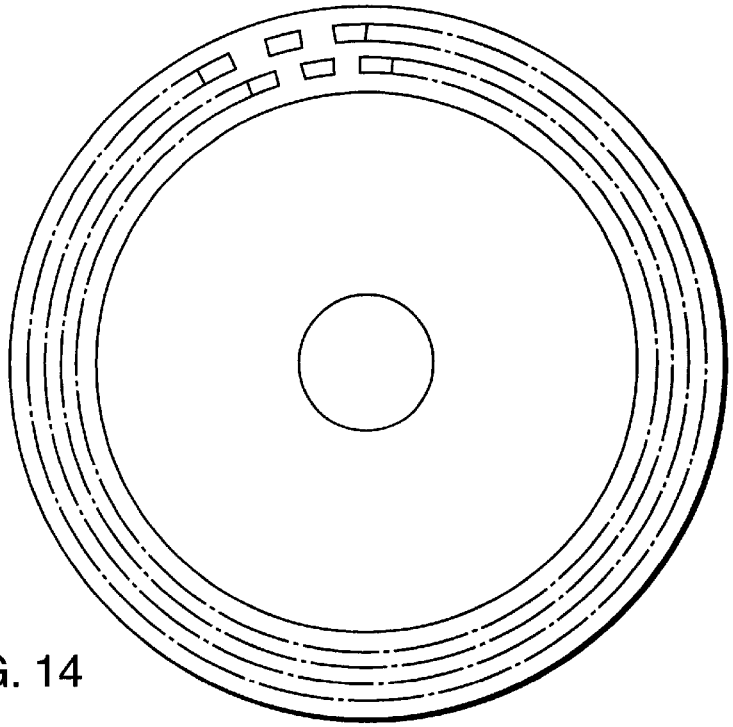
FIG. 14 is a rear plan view of a further ultra fine groove tool.
Figure 15:
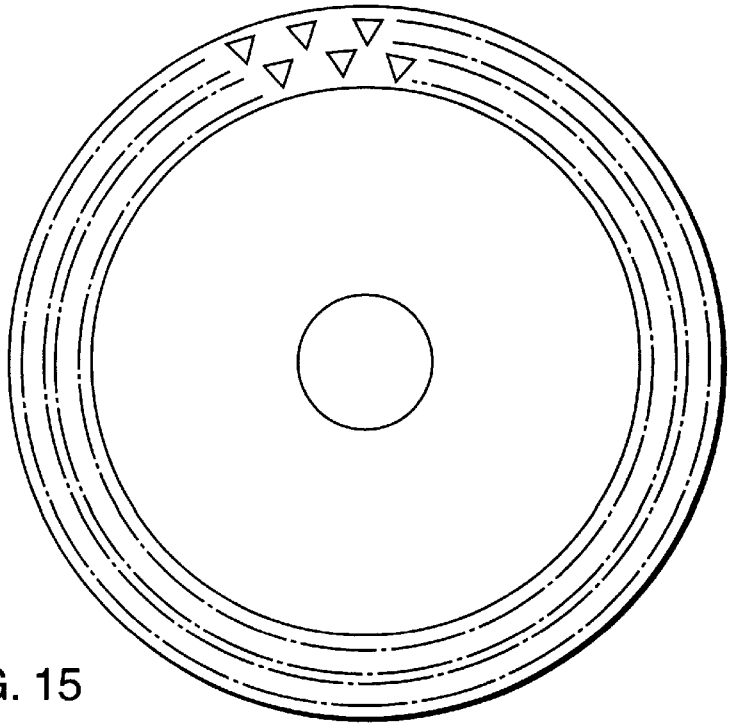
FIG. 15 is a rear plan view of yet another ultra fine groove tool.

FIGS. 14 and 15 are rear plan views of further ultra fine groove tools. These drawings show applications of the ultra fine groove tools, wherein the ultra fine groove chips are arranged with each of the ultra fine edge formed in rectangular and triangular shape. While these are almost the same as those illustrated in FIGS. 10 and 11, there are differences in the shapes of the ultra fine groove chips and their plural concentric arrangements. Further, the ultra fine edges may be formed in a circular or elliptical shape.

The present invention is comprised as described above and has the following effects regarding material to be processed and working conditions:

An optimum density distribution of cutting edges can be designed, and an optimum size of cutting edge and a distribution mode thereof can be designed. An ultra fine groove chip or tool with all cutting edges thereof having uniform orientation can be designed by choosing a crystal orientation less susceptible to wear and Initial protrusions of cutting edges can be leveled. As the heat generated when working can be stopped by the working fluid retained in the grooves, the degradation of cutting edges is suppressed. Further, grooves facilitate easy disposal of swarf, and the evenness of abrasion volume among the cutting edges owing to uniform crystal orientation brings about an excellent roughness value of the worked surface. The sustained cutting capacity of edges facilitates maintaining the depth of the work affected layer at a low level despite the increase in worked volume. Still further, the stabilized grinding permits maintaining working precision at a high level, and as the crystal orientation in the ultra fine edges can be made uniform at high density, a shear-mode processing is possible on those otherwise impossible materials.

What is claimed is:

1. An ultra fine groove tool comprising a rotatable base board and at least one ultra fine groove chip, wherein said base board has a circular shape and holds at least one ultra fine groove chip, said ultra fine groove chips being arranged in a row and being circularly mounted on said board, said ultra fine groove chips being made of single crystal diamond having a uniform crystallographic orientation and having a face, said face being engraved with a number of fine grooves to form a plurality of working surfaces in shear mode, whereby each working surface thus separated by said fine grooves constitutes an ultra fine edge.

2. An ultra fine groove tool as claimed in claim 1, wherein said diamond chip is mounted to said rotatable base board by a method of sintering, deposition, or plating.

3. An ultra fine groove tool as claimed in claim 1, wherein said rotatable base board has a rotation axis line and is mounted so as to rotate about the axis line, and said working surfaces are formed on said rotatable base board in a plurality of curved strips separated from the rotation axis by a plurality of coaxial arcs having different radii.

4. An ultra fine groove chip, wherein said chip is made of a single crystal diamond having a face, said face having a number of fine grooves engraved by such means as laser processing, machining, electric energy application, or by chemical vapor deposition, to form a plurality of working surfaces in shear mode, and whereby each working surface thus separated by said grooves constitutes an ultra fine edge.

5. An ultra fine groove chip as claimed in claim 4, wherein said grooves have a depth of at least 0.01 $\mu$m.

6. An ultra fine groove chip as claimed in claim 4, wherein each working surface has an area in a range of 0.0000001 to 100,000 $\mu m^2$.

7. An ultra fine groove chip as claimed in claim 4, wherein each working surface of said chip is shaped in a flat plane, a curved plane, or a combination of flat and curved planes.

8. An ultra fine groove chip as claimed in claim 4, wherein each working surface of said chip has a quadrilateral, a triangular, a circular, or an elliptical shape.

9. An ultra fine groove chip, wherein said chip is made of diamond having a face, said face having a number of fine grooves regularly engraved by such means as laser processing, machining, electric energy application, or by chemical vapor deposition, to form a plurality of working surfaces in shear mode, whereby said working surfaces thus sectioned by said grooves and arranged in matrix form constitute a plurality of ultra fine edges.

10. An ultra fine groove chip as claimed in claim 9, wherein said grooves have a depth of at least 0.01 $\mu$m.

11. An ultra fine groove chip as claimed in claim 9, wherein each working surface has an area in a range of 0.000001 to 100,000 $\mu m^2$.

12. An ultra fine groove chip as claimed in claim 9, wherein each working surface of said chip is shaped in a flat plane, a curved plane, or a combination of flat and curved planes.

13. An ultra fine groove chip as claimed in claim 9, wherein each working surface of said chip has a quadrilateral, a triangular, a circular, or an elliptical shape.

* * * * *